United States Patent [19]

Gudlauski et al.

[11] Patent Number: 4,571,089

[45] Date of Patent: Feb. 18, 1986

[54] MACHINE FOR BLENDING AND DEGASSING POWDERS

[75] Inventors: Edward B. Gudlauski; Thomas R. Wagner, both of New Hartford, N.Y.

[73] Assignee: United Technologies Corporation, Hartford, Conn.

[21] Appl. No.: 649,082

[22] Filed: Sep. 10, 1984

[51] Int. Cl.[4] ..... B01F 13/06; B01F 15/06; B01F 9/02

[52] U.S. Cl. ..... 366/139; 366/147; 366/235

[58] Field of Search ..... 366/139, 144, 145, 146, 366/147, 235

[56] References Cited

U.S. PATENT DOCUMENTS

| | | | |
|---|---|---|---|
| 2,628,080 | 2/1953 | Mack | 259/14 |
| 2,656,162 | 10/1953 | Fischer et al. | 259/14 |
| 2,816,371 | 12/1957 | Fischer | 366/147 |
| 2,838,392 | 6/1958 | Bielawski | 75/5 |
| 4,199,153 | 4/1980 | Martin | 277/4 |

*Primary Examiner*—Robert W. Jenkins
*Attorney, Agent, or Firm*—C. G. Nessler

[57] ABSTRACT

A machine for simultaneously blending and degassing powders under vacuum is comprised of a rotatable blender shell having a heated housing projecting into the interior, coaxial with the axis of rotation of the shell. Powder is heated to a relatively high temperature when it contacts the heater, while the shell remains comparatively cooler.

5 Claims, 1 Drawing Figure

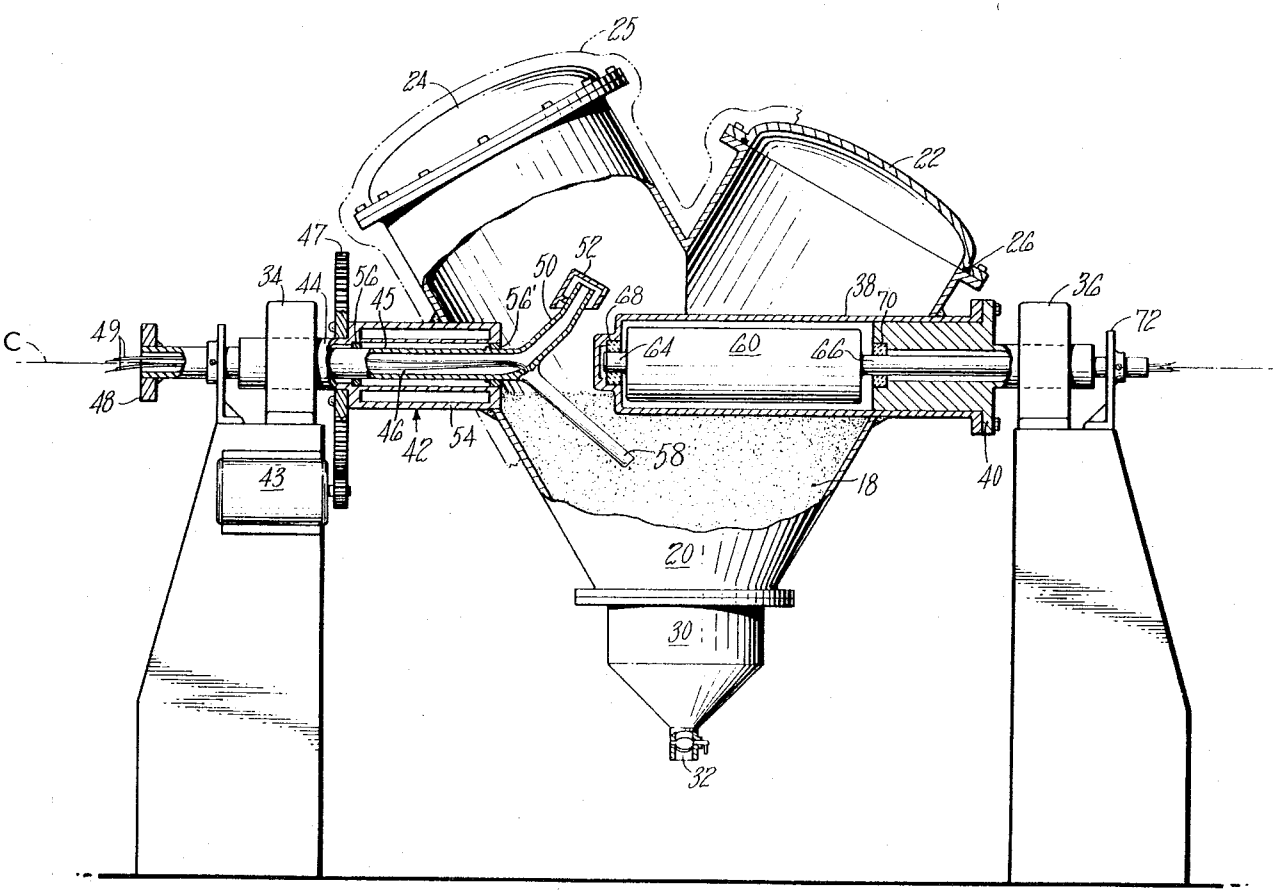
72
36
26
40
22
70
38
66
18
60
20'
30
32
64
58
68
25
52
50
56'
54
24
42
46
45
56
47
44
34
43
49
48
C

MACHINE FOR BLENDING AND DEGASSING POWDERS

TECHNICAL FIELD

The invention relates to the processing of powders, most particularly to simultaneous degassing and blending of metal powders.

BACKGROUND

The present invention is particularly addressed toward the processing of superalloy metal powders. Such powders have been used lately to fabricate structures useful at elevated temperatures, in particular, the parts of gas turbine engines. It is quite common that such parts are made by consolidating the powders by hot isostatic pressing. After such pressing, parts are often heat treated to change their metallurgical structures and develop the optimum properties desired.

To obtain the best properties, superalloy powders are atomized and processed under the inert atmosphere. This avoids contamination and unwanted surface films. But small quantities of gas and other volatiles can tend to become adsorbed by, or otherwise occluded with, the metal powders. Thus it has been found prudent to heat powders under vacuum to drive off such contaminants prior to the hot isostatic pressing step. This processing, often called baking or degassing, has been carried out in devices constructed for the purpose. For example, powder has been passed across a sloped and heated plate within a vacuum chamber. Commonly owned U.S. patent application No. 233,726 of Dizek et al, filed Feb. 12, 1981 describes such a process.

The blending step which is used to assure homogenity within a large lot of powder has usually been conducted prior to the baking step. But, it is desirable that powders be processed as few times as possible because non-volatile contaminants can be introduced at each processing step. Thus, in the making of the present invention it has been sought to combine the blending and baking steps. Simply heating the blender shell may appear to be an obvious step. For example, U.S. Pat. No. 2,628,080 of Mack shows a jacketed or double wall blender while U.S. Pat. No. 2,838,392 of Bielawski shows the inner wall of a blender lined with strip heaters. But, for typical superalloy powders the best results are obtained by heating to the vicinity of 700° F. At such temperatures most elastomer seal materials will not be durable and operating a blender at such temperatures presents sealing problems. If special high temperature seals are applied to the blender construction, advantages in ease of use, cost and durability are usually encountered.

DISCLOSURE OF THE INVENTION

An object of the invention is to simultaneously blend and degas metal powders. A further object of the invention is to heat superalloy powders to a relatively high temperature during vacuum degassing while not imposing undue temperature resisting requirements on a blender.

According to the invention, a machine for blending powders is comprised of a shell which contains the powder, similar to the shell of a conventional blender, which shell is adapted to rotate about a horizontal axis. A heater housing extends into the central part of the shell, co-axial with the axis of rotation. During use, the powder mass is constantly in contact with the relatively high temperature heater. The powders are heated to an elevated temperature by contact with the heater and thus are rapidly degassed, inasmuch as the interior of the blender is maintained under a vacuum.

A gas tube is mounted co-axial with the axis of rotation, at the opposite side of the blender shell. The gas tube is rotatably mounted in its housing, to enable the interior end to constantly be above the level of the powders contained within the machine.

Inasmuch as the heater housing is fastened to the shell, the housing rotates with the shell. In the preferred embodiment a heater is mounted on high temperature bearings within the heater housing and thus is able to be prevented from rotating while the shell of the machine rotates.

The foregoing and other objects, features and advantages of the present invention will become more apparent from the following description of preferred embodiments and accompanying drawing.

BRIEF DESCRIPTION OF THE DRAWING

The sole drawing shows a vee shaped twin shell blender in cross section.

BEST MODE FOR CARRYING OUT THE INVENTION

There are many different kinds of blenders for mixing powders. The present invention is particularly described in terms of a familiar double shell type blender, such as that shown in U.S. Pat. No. 2,656,162 to Fischer et al. A double shell blender constantly divides and recombines a powder mass as its V-shaped interior rotates about a cross axis. Such a blender must be completely closed to prevent escape of the powders during its operation, and to this end, covers are provided for charging and discharging the powders. Given this, such blenders are also convenient for maintaining powders under an inert atmosphere or other controlled environment during processing. It will be apparent that the invention also will be applicable to apparatuses of various other shapes, including such as the cone blender of the aforementioned Bielawski patent.

The sole FIGURE shows in cross section a double shell blender having the features of the invention. This blender is in a general sense typical of the type of blender known in the art and shown in the Fischer et al patent referred to above. The shell 20 is divided into two vee legs, the first terminating at a closure 22 and the second terminating at a closure 24. These closures are lids which are bolted or otherwise fastened to the shell. A typical high temperature seal 26 of the O-ring type is present at the flanged joint the closure 22 and the shell body.

The shell exterior is insulated to lessen heat loss as generally suggested by the phantom line 25. There is a third closure at the apex of the V-shape of the blender. This closure is attached to the shell similarly to the others, but the closure 30 is shaped internally like a cone and has a small valved opening 32 suitable for discharging powder vertically downward when the blender is stopped in the position shown in the FIGURE. A mass of powder 18 is shown contained within the lower portion of the blender shell.

The blender rotates about a horizontal axis C by virtue of its mounting in the bearings 34, 36 on opposite sides of the shell. A cylindrical heater tube housing 38 is welded to the wall of the shell 20 and extends from the interior to the exterior. A tubular heater 60 is contained within the heater tube housing. A flanged shaft 40 is bolted to the heater tube and provides the hollow shaft which enables rotation of the shell in the bearing 36. On the opposite side of the shell 20 a gas tube housing 42 is welded to the shell similarly to the heater tube housing. The gas tube housing has a larger cooling jacket portion 54 and a smaller portion 44 which constitutes a shaft mounted in the bearing 34. A motor 43 rotates a gear 47 affixed to the shaft part of the gas tube. Thus, the blender rotates about its horizontal axis C.

Rotatably contained within the gas tube housing is the gas tube 45. The tube has an interior passageway 46 which allows for the introduction or removal of gases to the shell interior. The flanged exterior end 48 of the tube is connected to a vacuum pump, source of inert gas, etc. or other fixed point external to the shell. The interior end 50 of the tube is bent upwardly at an angle to the axis of rotation C of the blender and there is an end cap 52 which prevents stray powder from entering the passageway. The tube 45 is journaled in bearings 56, 56' within the water cooled housing. (The slip ring connections and water connections are omitted for clarity. Also, there is a gas seal associated with bearing 56'.) Thus when the shell rotates, the gas tube will remain static, and the end 50 of the gas tube will always point upwardly. Inasmuch as gravity will tend to keep the powder mass 18 below the centerline of the apparatus, the end 50 will always be above the powder layer.

The gas tube also provides the means by which the temperature of the powder mass 18 is measured. Specifically, a temperature probe 58, such as a thermistor inside a sealed metal sleeve, projects at an angle downwardly from the gas tube, in generally the opposite direction from the end 50 of the gas tube. Wires 49 to the temperature sensor are conveniently run down the passageway 46 of tube 45, to the exterior.

Contained within the heater housing is a heater 60. This is preferably a conventional array of resistance heating elements. The heater has an end 64, which mounts in high a temperature (ceramic) bearing 68. There is a heat shield 70 around part 66. The outer end 66 of the heater is a shaft which extends through the interior of the piece 40, to the outermost fixed strut 72. Thus, when the blender rotates, the heater will remain static by rotating within the ceramic bearing. As the part of the housing extending inside the shell has no openings, no seals are needed and air or other gas fills the housing interior to enhance heat transfer from the heater.

From the above it will be appreciated that the gas tube end 50 will tend to always be above the powder mass while the temperature probe 58 will tend to be always immersed in the powder mass. Similarly it will be appreciated that the lowermost portion of the heater housing will tend to always be beneath the moving powder mass. The exterior surface of the heater housing is maintained at an elevated temperature by the heater. Thus, the powder is heated by conduction due to its contact with the housing surface inside the shell. By virtue of the normal rotational action of the blender and the inherent operation of the blender, there will be constant motion within the powder mass, and thus continuous interchange of the particles which are in contact with the heater tube. Note that to achieve the foregoing objects that the heater housing is relatively long and of high surface area, while the gas tube is relatively short and of low surface area, to facilitate evacuation and lessen any cooling effect.

To degas and blend powder, a mass of powder 18 is placed in the apparatus which is then sealed. The interior of the blender is then evacuated by connecting a vacuum source at point 48 to the passageway 46. Preferably, evacuation is sustained during the entire operation of the blender, but in other instances it might be desirable to backfill the interior with a gas. The blender is then rotated by the motor, at a speed which will be known to those familiar with the type of blender to be effective in blending. Power is applied to the heater to raise it to a temperature sufficient to cause outgassing of the metal powders. For superalloy powders this will be at least 500° F., typically 700° F. The powders are directly heated by conduction (and some ratiation) from the heater housing. When the individual particles are heated they merge with the other particles in the blender. As the powder mass comes in contact with the closures and shell, it heats them. However, given the dynamics of the heat transfer just described, it will be appreciated that the heater housing can be substantially hotter than the temperature of the other parts of the assembly. It is inherent that there will be a temperature gradient running from the heater housing to the shell and seal locations. In practice, the shell temperature tends to be at least 100°–200° F. less than the surface of the heater housing. Thus, particles which come into contact with the heater housing are heated to a higher temperature than the shell need be designed to sustain. This is significant in that higher particle temperatures are found to effectively speed outgassing but at the same time the shell structure must constantly resist an adverse pressure differential due to the vacuum. The first aspect leads to an aim of high powder mass temperature while the second aspect leads to an aim of low temperature (or costly construction). The invention described herein facilitates economic achievement of the desired result. When the powder has been sufficiently degassed, the rotation of the unit will be stopped, optionally after the powder has been allowed to cool within, and the powder is discharged from port 32 to a suitable evacuated container.

As mentioned above, the principles of the invention are applicable to different shapes of blenders. Generally, any configuration which causes the powders to move about as a changing shape mass in the bottom of the interior of the blender, while the blender is rotating about its horizontal axis, will be useful with the invention. While the heater in the present invention is mounted in bearings, in a variation of the essential invention the heater may be fixed with respect to the heater housing and slip rings or other rotatable electrical contacts may be used where the conductors of the heater project from the exterior of the heater housing.

Although this invention has been shown and described with respect to a preferred embodiment, it will be understood by those skilled in the art that various changes in form and detail thereof may be made without departing from the spirit and scope of the claimed invention.

We claim:

1. Apparatus for blending powders comprised of a shell positioned on a rotatable mounting for containing powders in a vacuum or a gaseous atmosphere; characterized by a heater housing attached to the shell and projecting into the shell interior, mounted co-axially with the rotatable mounting of the shell; a heater rotatably mounted within the heater housing, the heater remaining static when the shell and housing rotate; wherein rotation of the shell will cause any powders contained therein to contact the housing.

2. The apparatus of claim 1 wherein the shell has a vee shape characteristic of a double shell blender.

3. Apparatus for blending powders comprised of a shell positioned on a rotatable mounting for containing powders in a vacuum or gaseous atmosphere; a heater housing attached to the shell and projecting into the shell interior, the housing mounted co-axially with the rotatable mounting of the shell; means for evacuating the shell comprised of a gas tube rotatably mounted co-axial with the rotatable mounting of the shell and oppositely from the heater housing, the gas tube defining a passageway extending from the exterior to the interior of the shell and turning therein at an angle to the mounting, the gas tube adapted to rotate relative to the shell; wherein rotation of the shell causes the powders to contact the housing.

4. The apparatus of claim 3 characterized by a temperature probe attached to the interior end of the gas tube, extending at an angle opposite to the gas tube.

5. The apparatus of claim 3 characterized by a gas tube which is short and is forcibly cooled and a heater housing which is comparatively long and has no forced cooling.

* * * * *